US008083412B2

(12) United States Patent
Mino et al.

(10) Patent No.: US 8,083,412 B2
(45) Date of Patent: Dec. 27, 2011

(54) METHODS AND APPARATUS FOR TRANSPORTING BULK PRODUCTS

(76) Inventors: Oswaldo Mino, Houston, TX (US); Pablo Llopez-Miguel, Spring, TX (US)

( * ) Notice: Subject to any disclaimer, the term of this patent is extended or adjusted under 35 U.S.C. 154(b) by 858 days.

(21) Appl. No.: 11/961,855

(22) Filed: Dec. 20, 2007

(65) Prior Publication Data

US 2009/0159652 A1 Jun. 25, 2009

(51) Int. Cl.
*B65D 33/00* (2006.01)
*B65D 33/02* (2006.01)
*B65D 90/04* (2006.01)

(52) U.S. Cl. ..... 383/105; 383/119; 383/903; 220/1.6

(58) Field of Classification Search ..... 383/105, 383/119, 903; 220/1.6
See application file for complete search history.

(56) References Cited

U.S. PATENT DOCUMENTS

| | | | | |
|---|---|---|---|---|
| 3,809,279 | A | 5/1974 | Arjas | |
| 3,949,901 | A * | 4/1976 | Tokita | 222/94 |
| 4,237,653 | A | 12/1980 | Cortez | |
| 4,541,765 | A | 9/1985 | Moore | |
| 5,137,170 | A | 8/1992 | Matias | |
| 5,188,460 | A | 2/1993 | Dorse | |
| 5,203,633 | A | 4/1993 | Derby | |
| 5,222,621 | A | 6/1993 | Matias | |
| 5,289,937 | A * | 3/1994 | Boots | 220/9.1 |
| 5,316,387 | A * | 5/1994 | Polett et al. | 383/119 |
| 5,328,268 | A * | 7/1994 | Lafleur | 383/119 |
| 5,421,476 | A | 6/1995 | Matias | |
| 5,538,155 | A | 7/1996 | Hoekstra | |
| 5,542,563 | A | 8/1996 | Matias | |
| 5,641,179 | A | 6/1997 | Imlach | |
| 5,649,767 | A * | 7/1997 | Nickell et al. | 383/17 |
| 5,657,896 | A | 8/1997 | Matias | |
| 6,293,459 | B1 | 9/2001 | Burch, Jr. | |
| 6,481,598 | B1 | 11/2002 | Thornsen | |
| 6,565,256 | B2 | 5/2003 | Derby et al. | |
| 6,579,009 | B1 | 6/2003 | Schinasi | |
| 7,320,408 | B2 | 1/2008 | McMahon et al. | |
| 7,506,776 | B2 | 3/2009 | Podd | |
| 7,516,863 | B2 | 4/2009 | Siegers et al. | |
| 2003/0197009 | A1 | 10/2003 | Mino | |
| 2005/0173159 | A1 | 8/2005 | Murata et al. | |
| 2007/0024078 | A1 | 2/2007 | Mino et al. | |
| 2007/0235509 | A1 | 10/2007 | Townsend | |
| 2007/0267410 | A1 | 11/2007 | Mino et al. | |

* cited by examiner

*Primary Examiner* — Jes F Pascua
(74) *Attorney, Agent, or Firm* — Parks & Associates, P.C.

(57) ABSTRACT

A method and apparatus for transporting bulk products is shown. At least one example of an apparatus for transporting bulk products as disclosed herein comprises the following: a liner having a top panel, a bottom panel, two sidewalls, a front panel, and a back panel; a first strap, wherein the first strap is partially attached to each of the sidewalls and to the back panel so that the first strap has a first pair of diagonal sections, said first pair of diagonal sections comprising a first diagonal section suspended between a first sidewall and the back panel and a second diagonal section suspended between a second sidewall and the back panel; and a second strap, wherein the second strap is partially attached to each of the sidewalls and to the back panel, wherein at least one overlapping region of the second strap overlaps an overlapping region of the first strap. The apparatus may further include a third strap that is partially attached to each of the sidewalls and to the back panel similar to the first strap and the second strap.

12 Claims, 6 Drawing Sheets

METHODS AND APPARATUS FOR TRANSPORTING BULK PRODUCTS

BACKGROUND

1. Field of Invented Subject Matter

The invented subject matter relates to the transportation of bulk products, such as dry granular solids and the like. As but one example, the invented subject matter relates to container liners having support straps.

2. Description of Related Art

Container liners are commonly used for the transportation of bulk products in shipping containers, which are generally standard size maritime sea containers. These liners are typically designed as flexible rectangular housings so that they can be filled to maximize the surrounding rectangular shipping container space. Another type of liner also used in shipping containers is known as a "bulkhead" or "safety sheet." Such liner, which generally only includes two side wall portions, a floor, and an end face, corresponding to the shipping container door, is used to line the respective container areas prior to filling it with a product. In addition, each of these liners is generally provided with filling ports and discharge ports to assist the loading and unloading of the products.

When filling a flexible container liner with a product, the end face of the liner, corresponding to the door of the shipping container, has a natural tendency to bulge. Bulging causes the liner to protrude outwards from the shipping container. This bulge may obstruct the closing of the door of the container.

Many alternatives have been made to address this problem. For example, steel support bars have been positioned across the end face of the liner inside of the edges of the container door to add structural support to the liner. These steel bars help retain any bulging effect that may occur as the liner is filled with product. Depending on the flow and weight of the product, four to eight steel bars may be required to effectively oppose any bulging. Unfortunately, steel bars have become a major cost component, representing up to 50% of the total cost of the container liner.

Another example includes a container liner that can transport bulk material without the use of steel bars, commonly referred to as "brace-less" or "bar-less" liners. One type of bar-less liners includes a belt tensioning system with belts and ratchets that are attached, to the end face of the liner and anchored to the shipping container. The tensioning system is used to maximize the tension across the end face of the liner to counter against any bulging effects. However, this system involves a prolonged installation time due to the labor intensiveness associated with the proper tensioning of the belts on the end face. In addition, the performance of the tensioning system varies as the anchoring points inside of the shipping containers are not standardized and are often missing or located at different places within the container.

Therefore, there is a need for an effective liner system that can be used to transport numerous types of bulk product. There is also a need for a liner system that can accommodate large bulk product loading systems and facilitate a controlled bulk product discharge. There is a further need for a liner system that can be easily installed without the necessity of complex support systems.

SUMMARY

A method and apparatus for transporting bulk products is shown. At least one example of an apparatus for transporting bulk products as disclosed herein comprises the following: a liner having a top panel, a bottom panel, two sidewalls, a front panel, and a back panel; a first strap, wherein the first strap is partially attached to each of the sidewalls and to the back panel so that the first strap has a first pair of diagonal sections, said first pair of diagonal sections comprising a first diagonal section suspended between a first sidewall and the back panel and a second diagonal section suspended between a second sidewall and the back panel; and a second strap, wherein the second strap is partially attached to each of the sidewalls and to the back panel, wherein at least one overlapping region of the second strap overlaps an overlapping region of the first strap.

At least one example of an apparatus for transporting bulk products disclosed herein comprises the following: a liner for holding bulk products that includes a first sidewall, a second sidewall that is substantially parallel to the first sidewall, and an interconnecting panel disposed between the first and second sidewalls; a first strap that is partially attached to each of the first and second sidewalls and to the interconnecting panel, to provide a first pair of diagonal strap sections, which includes a first diagonal strap section suspended between the first sidewall and the interconnecting panel, and a second diagonal strap section suspended between the second sidewall and the interconnecting panel; and a second strap that is partially attached to each of the first and second sidewalls and to the interconnecting panel, wherein at least a first portion of the first strap overlaps at least a first portion of the second strap to provide a first composite strap structure that includes two overlapping strap portions.

At least one example of an apparatus for use with a container as disclosed herein comprises the following: a liner comprising a housing; and a first strap, wherein the strap is partially attached to an outer surface of the housing and to an inner surface of the housing so the strap has a first pair of diagonal sections, suspended within the housing.

At least one example of an apparatus for use with a container as disclosed herein comprises the following: a liner having at least two sidewalls, a front panel, and a back panel; and a first strap partially attached to each of the sidewalls and the back panel so that the strap has a first pair of diagonal sections, said first pair of diagonal sections comprising a first diagonal section suspended between a first sidewall and the back panel and a second diagonal section suspended between a second sidewall and the back panel, wherein the first pair of diagonal sections comprises a plurality of apertures.

At least one example of an apparatus for use with a container as disclosed herein comprises the following: a liner having a top panel, a bottom panel, two sidewalls, a front panel, and a back panel; and a first strap partially attached to each of the sidewalls and the back panel so that the strap has a first pair of diagonal sections, said first pair of diagonal sections comprising a first diagonal section suspended between a first sidewall and the back panel and a second diagonal section suspended between a second sidewall and the back panel, wherein the back panel is wider than the front panel.

Also disclosed is at least one example of a method for transporting material in a container that comprises the following: loading the material into a liner disposed in the container; restraining the liner by attaching a first strap and a second strap inside of the liner so that a first and second pair of diagonal sections are suspended inside of the liner, wherein a portion of the second strap overlaps the first strap; transporting the material; and unloading the material.

DETAILED DESCRIPTION

A. Introduction and Definitions

Figure 1:
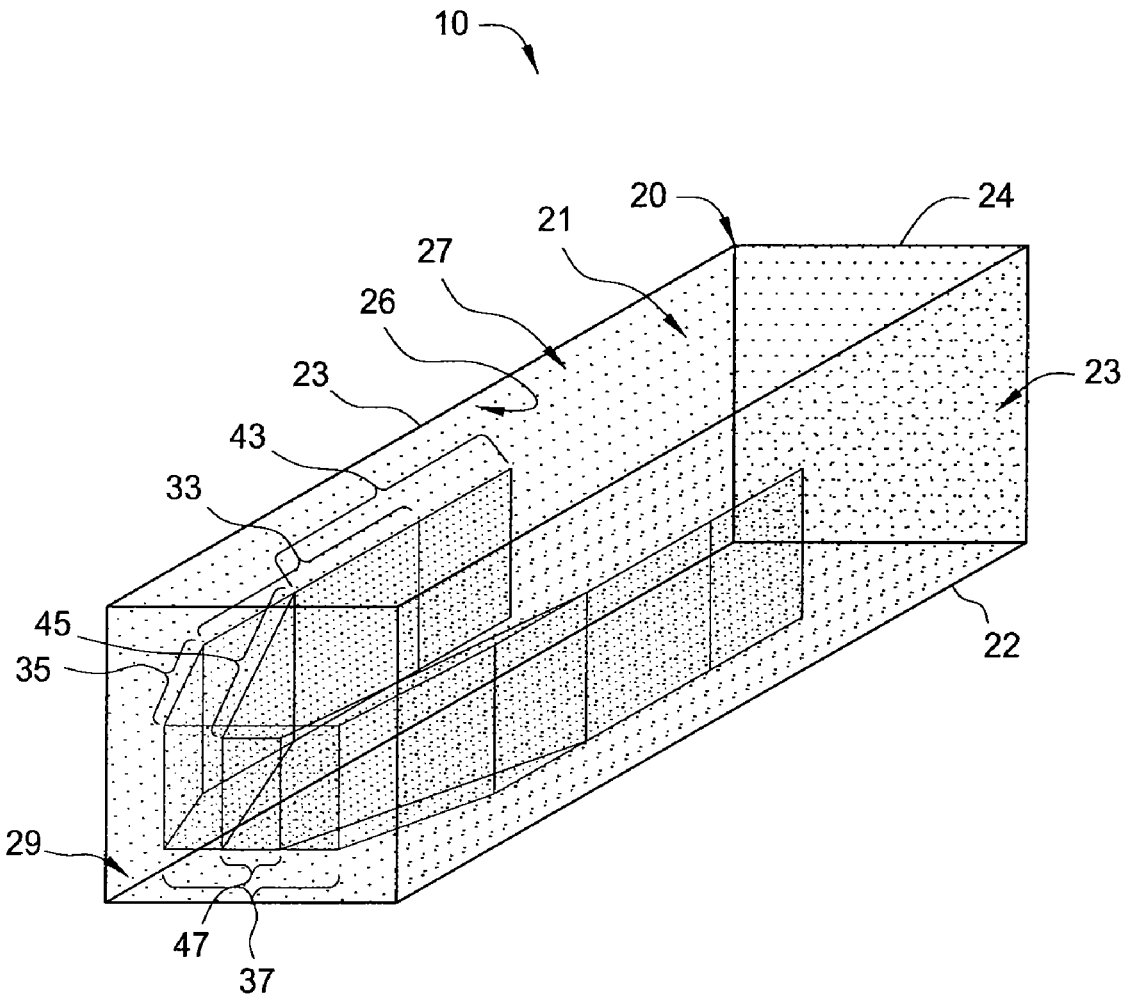
FIG. 1 is a perspective view of a transport system.

A detailed description will now be provided. Each of the appended claims defines a separate invention, which for infringement purposes is recognized as including equivalents to the various elements or limitations specified in the claims. Depending on the context, all references below (and elsewhere herein) to the "invention" may in some cases refer to certain specific embodiments only, since it is recognized that each claim may have different elements or limitations than others. In other cases it will be recognized that references to the "invention" will refer to subject matter recited in one or more, but not necessarily all, of the claims. Each of the inventions will be described in greater detail below, including specific embodiments, versions, and examples, but the inventions are not limited to those embodiments, versions, or examples, which are included to enable a person having ordinary skill in the art of designing bulk transportation systems, such as container liners, to make and use the invention, when the information in this patent is combined with available information and technology. Various terms as used herein are defined below. To the extent a term used in a claim is not defined below, it should be given the broadest definition persons in the pertinent art have given that term, as reflected in printed publications, issued patents, and dictionaries.

The term "liner" as used herein refers broadly to any flexible structure that is capable of supporting bulk products such as dry granular solids. At least one type of "liner" has a rectangular cube shape, including sidewalls and panels, and can be shaped and sized to fit into a standard shipping container. An alternative type of a "liner" has a partial housing shape, including two sidewalls, a bottom panel, and a back panel, wherein the sidewalls only correspond to a portion of the shipping container sidewalls. As used herein, the term "liner" may refer to the structure itself, i.e., including the sidewalls and panels, to the exclusion of straps, or alternatively, to the structure plus the straps. An example of a liner is seen in the drawings herein. An example of a liner is also seen in U.S. Pat. No. 6,579,009, which could be modified in accordance with the invented subject matter described herein. An example of a liner is also a "bulkhead" or "safety sheet" as commonly recognized in the related industry. The liner may be a flexible structure that is made from a polyethylene, polypropylene, or other similar material. The liner may be shaped similar to the shipping container in order to maximize the shipping space. However, the liner may have any suitable shape known to a person of ordinary skill.

The term "strap" as used herein refers broadly to a flexible planar structure used to restrain expansion of the liner by a product. The restraining strength of the strap may derive from a weaving of the material used to form the strap. The strap may be made a flexible planar structure that is made from a polyethylene, polypropylene, or other similar material. The strap preferably includes a U-shaped design that comprises side portions, diagonals, and a center portion that are stitched to the liner and are used to interconnect the panels/walls of the liner, as will be more fully discussed herein. Preferably, the strap may comprise an interconnecting strap panel.

B. Specific Embodiments

Examples of the benefits resulting from the use of the various embodiments discussed herein may include the following: an increase in transportation safety from the ability of the present invention to maximize the bulk cargo containment and eliminate build-up pressure behind the shipping container doors, caused by the shifting of the bulk product during transit, which can potential harm an operator when opening the container doors under such hydrostatic pressure; a reduction of packaging and recycling costs by eliminating the necessity of using more costly containment cargo systems, typically consisting of multiple steel bars; and a utilization of 100% of the payload capacity of the shipping container.

An apparatus for transporting bulk products may include a liner having a bottom panel, two sidewalls, and a back panel. The apparatus may also include a first strap and a second strap that may be partially attached to each of the sidewalls, which may include a first sidewall and a second sidewall. For example, the straps may have side portions that are attached along the sidewalls. The side portions may be stitched to the sidewalls. Alternatively, the side portions may be hooked, tied, bonded, or attached to the sidewalls in other ways known to a person of ordinary skill. The side portions may also be longitudinally attached to the sidewalls. For example, the side portions may extend from the end of the sidewall adjacent to the front panel to within a couple of feet of the opposite end of the sidewall adjacent to the back panel, or any other range therebetween. A side portion of the first or second pair may be equally attached to the opposite sidewall or attached to the sidewall in a different manner than the opposing side portion. For example, a side portion of the first or second pair may be longer or shorter in length than the opposing side portion. Also, the side portions of one strap may be attached by a similar or alternative means as the side portions of the other strap. Finally, the side portions may be formed from a polyethylene, polypropylene, or other similar material.

The first strap and the second strap may be partially attached to the back panel. For example, the straps may have center portions that are attached along the back panel. The center portions may be stitched to the back panel. Alternatively, the center portions may be hooked, tied, bonded, or attached to the back panel in other ways known to a person of ordinary skill. The center portions may also be longitudinally attached to the back panel. For example, the width of the center portions may extend to within a foot of the width of the back panel, or any other range therebetween. The center portion of the first strap may be longer in length than the center portion of the second strap. For example, the center portion of the second strap may extend half of the width of the center portion of the first strap. A center portion of one strap may be attached by a similar or alternative means as the center portion of the other strap. Also, the center portions may be attached to the back panel by a similar or alternative means as the side portions to the sidewalls. Finally, the center portions may be formed from a polyethylene, polypropylene, or other similar material.

The second strap may have at least one overlapping region that overlaps an overlapping region of the first strap. An overlapping region of the second strap may overlap the overlapping region of the first strap on each of the sidewalls and the back panel. For example, a first overlapping region of the second strap may overlap a first overlapping region of the first strap on the first sidewall, a second overlapping region of the second strap may overlap a second overlapping region of the first strap on the second sidewall, and a third overlapping region of the second strap may overlap a third overlapping region of the first strap on the back panel. The amount and location of overlap between the straps may vary.

The straps may be positioned between a top panel and the bottom panel. For example, the straps may be centered between the top and bottom panels or the straps may be positioned adjacent to the top or bottom panel. However, the straps may be positioned at different heights between the panels, depending on the desired location. Alternatively, the side portions and center portions of the straps may be positioned at different heights between the panels, depending on the desired location.

The first strap may have a first pair of diagonal sections. For example, the first pair of diagonal sections may include a first diagonal section suspended between the first sidewall and the back panel and a second diagonal section suspended between the second sidewall and the back panel. The second strap may have a second pair of diagonal sections. For example, the second pair of diagonal sections may include a third diagonal section suspended between the first sidewall and the back panel and a fourth diagonal section suspended between the second sidewall and the back panel. The diagonal sections may be attached to the ends of the side portions and the center portions. The shapes of the diagonal sections may be square, trapezoidal, or any other suitable shape known by one of ordinary skill. For example, the diagonal sections can have a sail-type shape. The sail-type shape includes a top and/or bottom edge of the diagonal sections that descends from the sidewalls to the back panel. Also, the lengths of the diagonal sections may be equal or differ. For example, the second pair of diagonal sections may be longer than the first pair of diagonal sections or the lengths of the diagonals of either pair may be equal or differ. The angles of the diagonals are preferably as vertical as possible to maximize the restraining strength over the back panel by the straps. Finally, the diagonal sections may be formed from a polyethylene, polypropylene, or other similar material.

The first pair of diagonal sections and the second pair of diagonal sections may each have a plurality of apertures. The number, location, and shape of the apertures on each diagonal may be equal or differ. These features may also be similar or different between the pairs of diagonal sections. The apertures help facilitate the flow of material within the liner, as it is being loaded, unloaded, or transported.

The liner may have a third strap partially attached to each of the sidewalls and the back panel. The third strap may have a third pair of diagonal sections. For example, the third pair of diagonal sections may include a fifth diagonal section suspended between the first sidewall and the back panel and a sixth diagonal section suspended between the second sidewall and the back panel. The third strap may also have a side portion attached along the sidewall and may be attached by a similar or alternative means as the side portions of the first or second straps. The third strap may also have a center portion attached along the back panel and may be attached by a similar or alternative means as the center portions of the first or second straps. Part of the side portions of the third strap may overlap part of the side portions of the second strap and/or may overlap part of the side portions of the first strap. The amount of overlap between the three straps may vary. Finally, the third strap may be formed from a polyethylene, polypropylene, or other similar material.

The liner may have a support bar disposed adjacent to the back panel. At least one metallic bar may be placed adjacent to the back panel to help restrain the liner. Depending on the product, loading/unloading method, etc., multiple metallic bars can be used to add additional support to the liner. The metallic bars may be attached to the liner or the shipping container during any stage of the transportation process.

It is important to note that the shapes and sizes of the straps should be designed to allow the positioning of the straps between the top panel and bottom panel in a manner that clears the bottom portion of the liner for the free flow of the material while discharging/unloading.

It is also important to note that the positions, locations, features, and dimensional attributes of the side portions, center portions, and diagonal sections, can be adjusted to accommodate different types of bulk products and different types of loading and unloading methods. The various embodiments of one strap may be equally applicable to the other straps that are discussed herein. Various combinations of embodiments may also be utilized on any of the straps that are discussed herein.

An apparatus for transporting bulk products may include a liner for holding bulk products that may include a first sidewall, a second sidewall that is substantially parallel to the first sidewall, and an interconnecting panel disposed between the first and second sidewalls. The apparatus may also include a first strap that is partially attached to each of the first and second sidewalls and to the interconnecting panel, to provide a first pair of diagonal strap sections. The first pair of diagonal strap sections may include a first diagonal strap section suspended between the first sidewall and the interconnecting panel and a second diagonal strap section suspended between the second sidewall and the interconnecting panel. The apparatus may also include a second strap that is partially attached to each of the first and second sidewalls and to the interconnecting panel, so that at least a first portion of the first strap overlaps at least a first portion of the second strap to provide a first composite strap structure that includes two overlapping strap portions. The two overlapping strap sections may be affixed in planar and parallel relation to one another.

The apparatus may include a second portion of the first strap that overlaps at least a second portion of the second strap to provide a second composite strap structure that includes two overlapping strap portions. The apparatus may also include a third portion of the first strap that overlaps at least a third portion of the second strap to provide a third composite strap structure that includes two overlapping strap portions.

The first composite strap structure may be affixed to the first sidewall. The second composite strap structure may be affixed to the second sidewall. The third composite strap structure may be affixed to the interconnecting panel. The interconnecting panel may be a back panel, and the liner may additionally include a front panel, a top panel, and a bottom panel.

An apparatus for holding material may include a liner that forms a housing and a first strap. The housing may include at least a bottom panel, two side walls, and a back panel. The first strap is partially attached to an outer surface of the housing and to an inner surface of the housing so the strap has a first pair of diagonal sections that are suspended within the housing.

The first strap may have an adhesive surface. The adhesive surface may allow the strap to adhere to the walls of a shipping container. The adhesive surface may include a glue, tape, or other similar adhesion-type means or materials.

The apparatus for holding material may also include a second strap that is partially attached to the outer surface of the housing and to the inner surface of the housing so that the strap has a second pair of diagonal sections suspended within the housing.

The second strap may include a portion that overlaps the first strap. The portion of the second strap may overlap the first strap on the sidewalls and the back panel. For example, more than half of the side portion of the first strap may overlap the side portion of the second strap. However, the amount and location of overlap between the straps may vary.

The first strap may be adapted to traverse through the housing. For example, slits, which can be effectively sealed, can be cut in the housing to allow the strap to attach to the inner surface of the housing. Once the strap traverses through the housing and is attached to the inner surface, the first pair of diagonal sections is suspended within the housing.

The first pair of diagonal sections may also include a plurality of apertures. The number, location, and shape of the apertures on each diagonal may have be equal or differ. These features may also be similar or different between different pairs of diagonal sections. The apertures help facilitate the flow of material within the liner, as it is being loaded, unloaded, or transported.

An apparatus for holding material may include a liner that has at least two sidewalls and a back panel. The apparatus may also include a first strap that is partially attached to each of the sidewalls and the back panel so that a first pair of diagonal sections are suspended between the sidewalls and the back panel. The first strap may have a center portion that is shorter than a side portion of the strap.

The apparatus may also include a second strap that is partially attached to each of the sidewalls and the back panel so that the strap has a second pair of diagonal sections suspended between the sidewalls and the back panel. The second strap may have a center portion that is shorter than a side portion of the strap.

The first pair of diagonal sections may have a top edge that descends from the sidewalls to the back panel. The descending edge creates a sail-type shaped diagonal that will increase the open area on the back panel due to a reduced height of the center portion. This open area can be utilized to accommodate a greater range of loading and/or unloading devices which require available area on the back pane.

The first pair of diagonal sections may also include a plurality of apertures. The number, location, and shape of the apertures on each diagonal may have be equal or differ. These features may also be similar or different between different pairs of diagonal sections. The apertures help facilitate the flow of material within the liner, as it is being loaded, unloaded, or transported.

An apparatus for holding material may include a liner having a bottom panel, two sidewalls, and a back panel. The apparatus also includes a first strap that is partially attached to each of the sidewalls and the back panel so that a first pair of diagonal sections is suspended between the sidewalls and the back panel.

The back panel may be retracted inward from a planar face perpendicular to the first and second sidewalls. The back panel may be wider than a front panel. The increased width of the back panel allows it to be retracted inward by shorter diagonal sections. Alternatively, the width of the back panel and front panel may be identical. However, the back panel should be pulled in by the diagonal sections, resulting into a slightly narrower opening on the back of the liner, i.e. the back panel is curved inward towards the inside of the liner. The amount by which the width of the back panel is increased or the amount by which the back panel is pulled in by the diagonal section may depend upon the percentage of expansion of the material from which the back panel if formed. For example, if the material is allowed to expand 15%, then the back panel will be retracted inward so that when it expands 15%, the face of the back panel will be substantially aligned with the door of the shipping container, i.e. the planar face perpendicular to the sidewalls. In addition, the diagonal sections can be attached to back panel at different locations to help uniformly distribute the expansion of the panel.

The apparatus may also include a second strap that is partially attached to each of the sidewalls and the back panel so that a second pair of diagonal sections is suspended between the sidewalls and the back panel.

The first pair of diagonal sections may have a plurality of apertures. The number, location, and shape of the apertures on each diagonal may have be equal or differ. These features may also be similar or different between different pairs of diagonal sections. The apertures help facilitate the flow of material within the liner, as it is being loaded, unloaded, or transported.

A method for transporting a material in a container may include the step of loading the material into a liner disposed in the container. Loading the material may be facilitated through a loading port disposed above the first and second straps. The loading port may be adapted to various types of loading methods such as pouring product into the liner, hooking the port to a conveyor that delivers product into the liner, or a controlled loading with the use of a pump or blower to transmit the product into the liner.

The method may include the step of restraining the liner by attaching a first strap and a second strap inside of the liner so that a first and second pair of diagonal sections are suspended inside of the liner and a portion of the second strap overlaps the first strap.

The method may include the step of transporting the material in the liner. For example, the material in the liner may be disposed in a shipping container. The shipping container may be transported by air, sea, rail, or any other means known by a person of ordinary skill.

The method may include the step of unloading the material. Unloading the material may be controlled through a discharge port disposed below the first and second straps. The discharge port may be adapted to various types of unloading methods, such as tilting the container and allowing the product to pour out of the liner through the port, or controlling the discharge through the port with the use of a pump or blower to transmit the product out of the liner.

The liner may have a discharge sleeve. The discharge sleeve may be made from the same or similar material as the liner or the straps. The sleeve may be utilized to protect a product from contamination as the product is being unloaded from the liner into another compartment. The sleeve can be attached to the back panel near the discharge port and can be folded or rolled up when it is not in use.

Various types of loading and unloading systems can be adapted for use with the transport system of the present invention. Further embodiments of the present invention include combinations of these loading and unloading features.

C. Embodiments Depicted in the Figures

For purposes of enabling a person of ordinary skill in the art to make and use the invented subject matter, reference will now be made to specific embodiments of the invention that are illustrated in the drawings herein. It is understood, however, that the invention is not limited or restricted to the specific embodiments in the drawings, so that the discussion below is intended only to illustrate and explain some very specific examples of the invention.

FIG. 1 depicts a transport system 10, which can also be expressed as an apparatus for transporting bulk products. The system 10 includes a liner 20 that is shaped as a flexible rectangular housing, which would be placed inside of a standard maritime sea shipping container (not shown). The liner 20 has a top panel 21, a bottom panel 22, two sidewalls 23, a front panel 24, and a back panel 25. The back panel 25 corresponds to an opening or a door of standard shipping containers. The loading and unloading of the liner 20 is facilitated through the back panel 25. The liner 20 is shaped similar to the shipping container in order to maximize the shipping space.

The system 10 further includes a first strap 30 and a second strap 40 attached to the inside of the liner 20. Both of the straps are positioned between the top panel 21 and the bottom panel 22, and parts of the second strap 40 overlap parts of the first strap 30. Specifically, the second strap 40 overlaps a portion of the first strap 30 along the sidewalls 23 and the back panel 25.

The first strap 30 has a side portion 33 that is attached to an inner surface 26 of the sidewall 23. The first strap 30 also has a center portion 37 that is attached to an inner surface 29 of the back panel 25 so that the strap has a first pair of diagonal sections 35 that are suspended between the back panel 25 and the sidewalls 23. The first pair of diagonal sections 35 has one end that is attached to the sidewalls 23 at one end of the side portion 33. The first pair of diagonal sections 35 also has one end that is attached to the back panel 25 at one end of the center portion 37. Each diagonal section has one side adjacent to a side portion and another side adjacent to the center portion.

The second strap 40 has similar parts as the first strap 30, including a side portion 43, a center portion 47, and a second pair of diagonal sections 45. The side portion 43 is attached along the inner surface 26 of the sidewall 23. Part of side portion 43 overlaps part of the side portion 33 of the first strap 30. The center portion 47 is attached along the back panel 25, so that a second pair of diagonal sections 45 is suspended between the panel and the sidewalls. The center portion 47 of the second strap 40 does not extend the entire width of the center portion 37 of the first strap 30. Also, the second pair of diagonal sections 45 is longer than the first pair of diagonal sections 35.

Referring to FIG. 1, as the liner 20 is filled with a bulk product it will fill out into the surrounding walls of the shipping container (not shown). The back panel 25, which corresponds to the opening of the container, will slowly begin to bulge outward because it will not have an adjacent surface of the shipping container to resist the flow of the material since the door of the container will be open. However, as the product begins to fill above the straps 30 and 40, the product will exert a force along the side portions 33 and 43 of the straps, pressing the side portions against the container walls. Although the product will further exert a pressure against the back panel 25 and generate a bulging effect, the center portions and diagonal sections will pull back and restrain the liner against the bulging by the side portions which are anchored to the container walls. The tension produced in the back panel 25 by the straps will restrain and distribute the bulging effect across the back panel.

Figure 2:
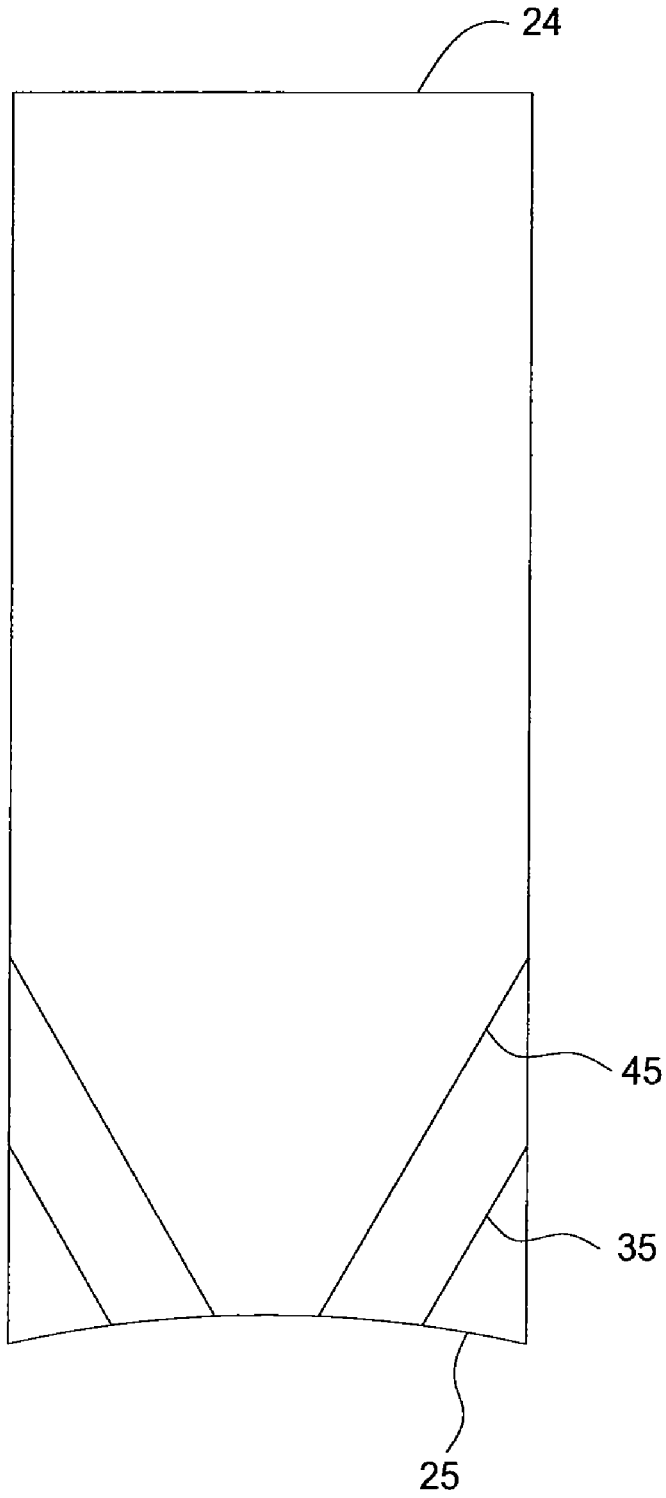
FIG. 2 is a top view of the transport system of FIG. 1, showing a distribution of bulges and a recessed back panel.

As explained above, FIG. 2 will help illustrate the distribution of the bulging effect. FIG. 2 shows a top view of the transport system 10. The diagonal sections 35 and 45 are attached at four points across the back panel 25. When the product beings to bulge out of the back panel 25, it will be divided into five smaller bulging areas. Instead of one large protrusion, the straps will divide the bulge into several smaller bulges between the points where the diagonal sections 35 and 45 of the straps are attached to the back panel 25 so that the door of the container can easily be closed. Also shown is that the second pair of diagonal sections 45 is longer than the first pair of diagonal sections 35 to restrain the back panel 25 across its entire width.

The angles of the diagonals are preferably as vertical as possible to maximize the restraining strength over the back panel 25 by the straps.

The widths of the back panel 25 and the front panel 24 are preferably identical. However, the back panel 25 should be pulled in by the diagonal sections, resulting into a slightly narrower opening on the back of the liner, i.e. the back panel 25 is curved inward towards the inside of the liner. The lengths of the diagonal sections 35 and 45 are dimensioned to retract the back panel 25 about 15% from a linear plane perpendicular to the ends of the sidewalls 23 near the back panel. This feature helps accommodate for the 15% expansion that a liner or straps made out of polyethylene, polypropylene, or other similar material will normally allow. Therefore, as the back panel 25 is expanded outwards about 15%, the panel will ultimately lie along the linear plane between the sidewalls and allow the door of the container to be opened and closed.

Figure 3A:
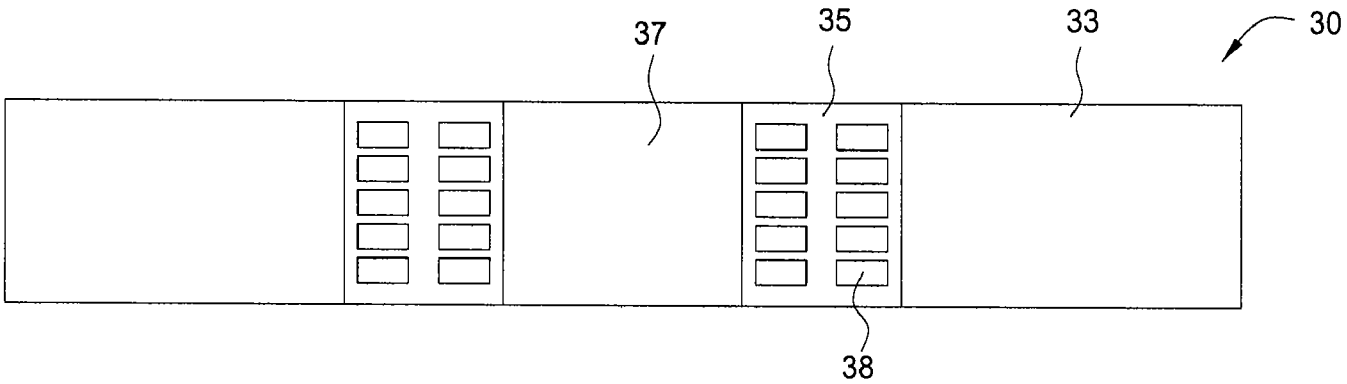
FIG. 3A is a front view of a first strap on the transport system shown in FIG. 1.
Figure 3B:
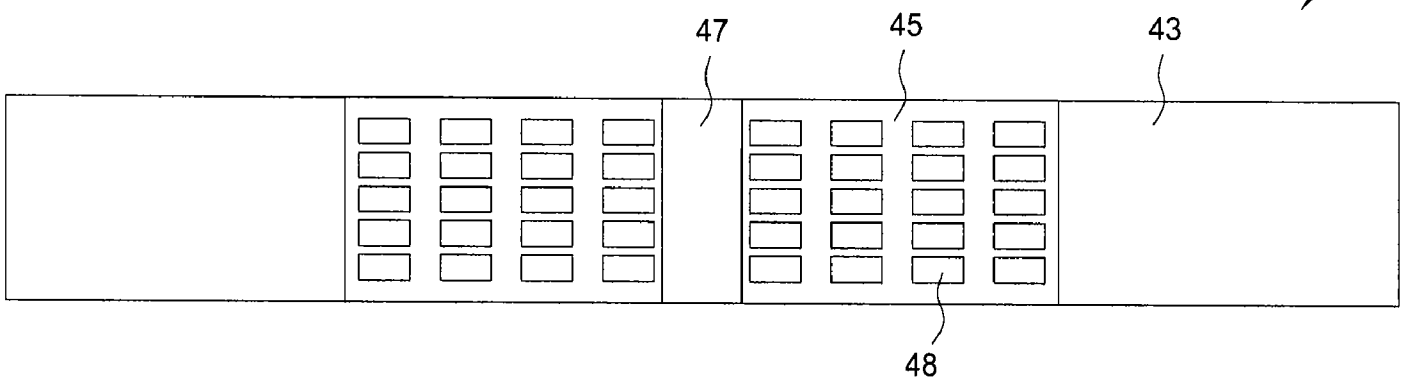
FIG. 3B is a front view of a second strap on the transport system shown in FIG. 1.

FIGS. 3A and 3B illustrate the first strap 30 and the second strap 40, respectively. The side portions 33 and 43 of the straps are wider than the center portions 37 and 47. Similarly, the center portion 37 of the first strap 30 is wider than the center portion 47 of the second strap 40. Similarly still, the second pair of diagonal sections 45 is wider than the first pair of diagonal sections 35. The diagonal sections of the straps contain a plurality of apertures 38 and 48 to help facilitate the flow of the product within the liner. The first pair of diagonal sections 35 has two columns and five rows of square-shaped apertures, centrally positioned on each diagonal. The second pair of diagonal sections 45 has twice as many similarly situated apertures on each diagonal. As the liner is being loaded, unloaded, or transported with material, the material will be able to travel through the apertures in the diagonal sections.

Figure 4A:
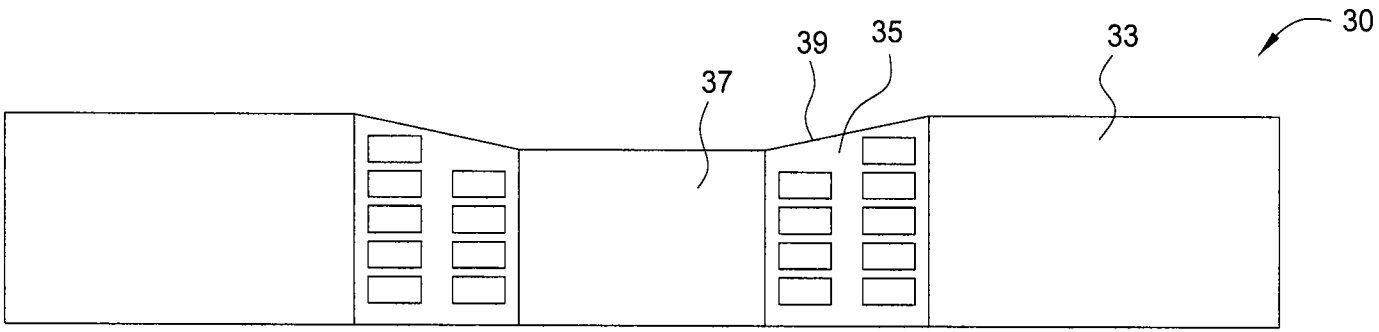
FIG. 4A is a front view of a first sail-type strap on the transport system.
Figure 4B:
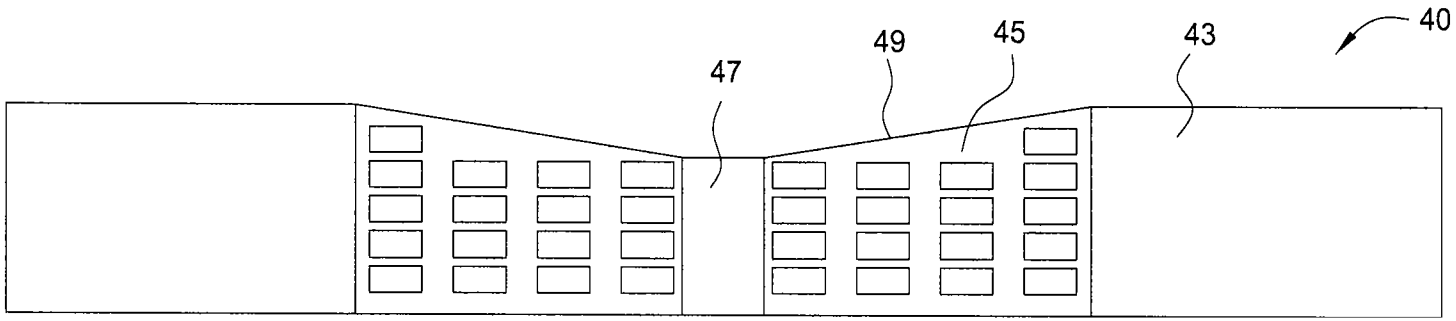
FIG. 4B is a front view of a second sail-type strap on the transport system.

FIGS. 4A and 4B illustrate the first strap 30 and the second strap 40, respectively. In these figures, the diagonal sections 35 and 45 have top edges 39 and 49 that descend from the side portions to the center portions, forming a sail-type shape. As a result, the heights of the center portions are shorter than the respective side portions of the straps. This sail-type shape allows the liner to accommodate large bulk loading systems by providing a more open area at the top part of the back panel. In addition, the diagonal sections of the straps contain a plurality of square-shaped apertures positioned on the sail-type shape of each diagonal.

Figure 5:
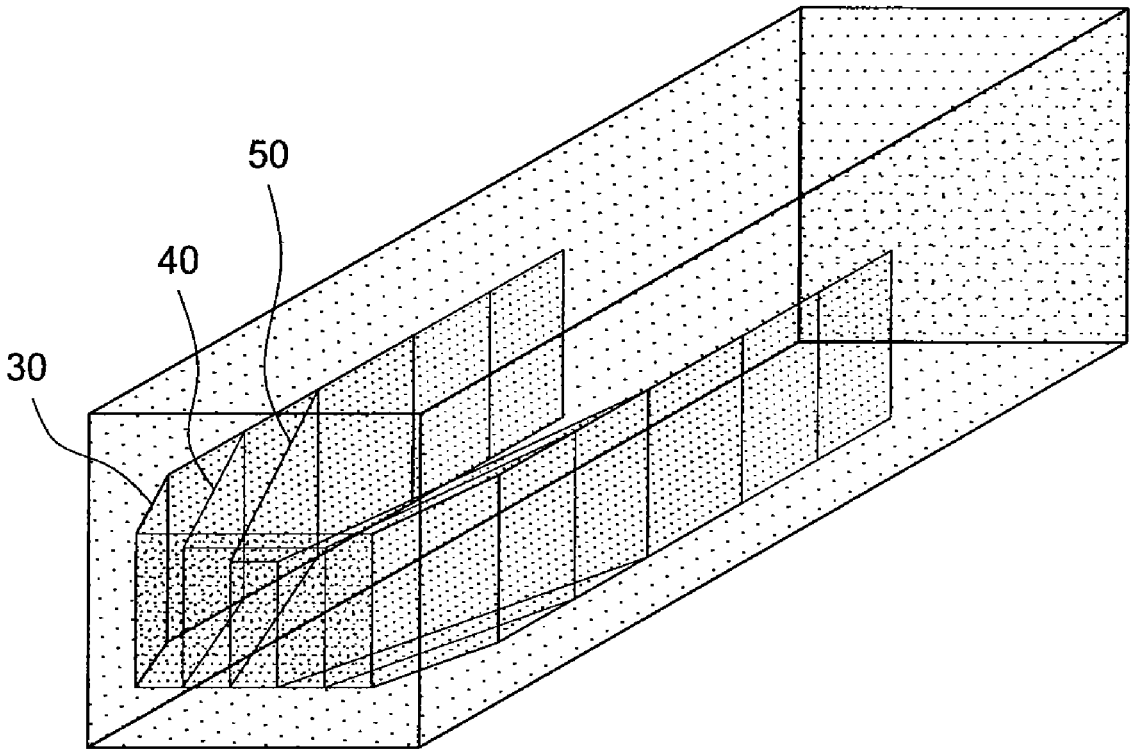
FIG. 5 is a perspective view of another type of transport system.

FIG. 5 shows the transport system 10. This figure is similar in most respects to FIG. 1, except that a third strap 50 is further utilized to add more restraining power to the liner. The third strap 50 includes a side portion 53, a center portion 57, and a second pair of diagonal sections 55. The side portion 53 is attached along the inner surface 26 of the sidewall 23. Part of side portion 53 overlaps part of the side portion of the second strap 40 and part of the side portion of the first strap 30. The center portion 57 is attached along the back panel 25, so that a third pair of diagonal sections 55 is suspended between the panel and the sidewalls.

Figure 6:
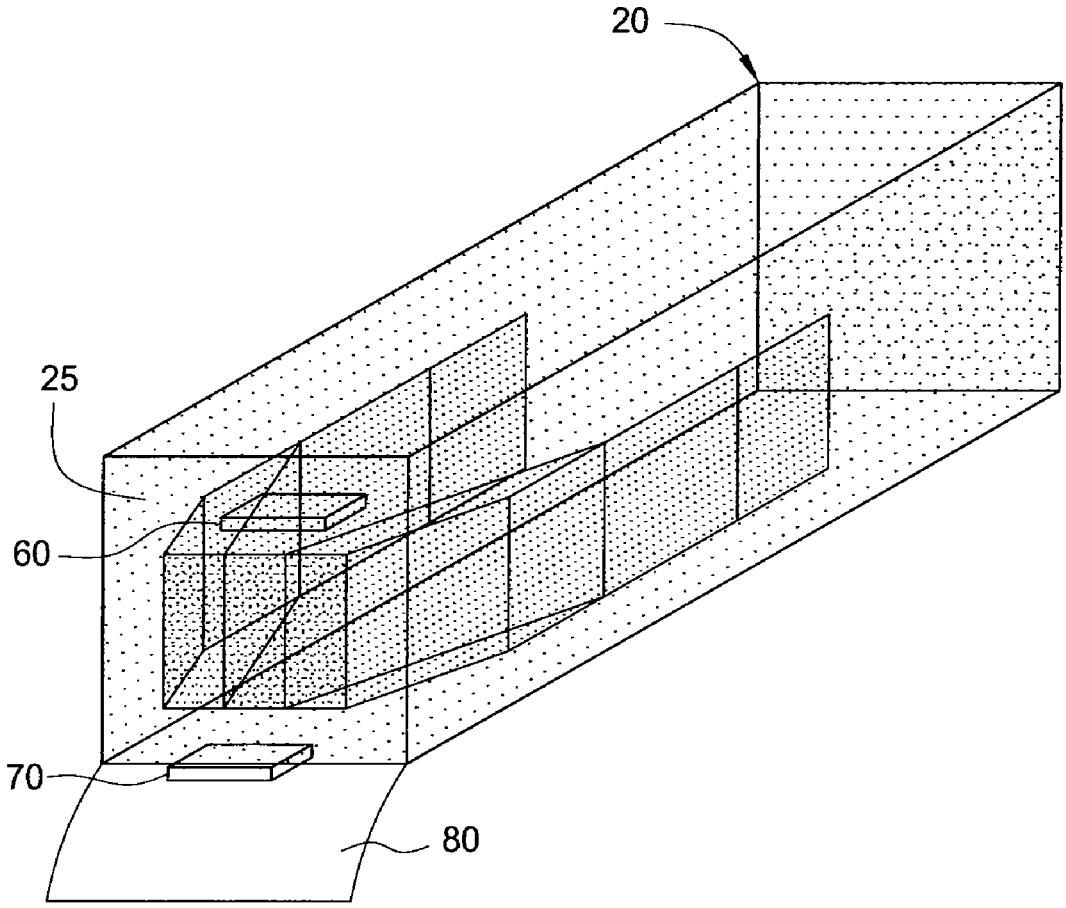
FIG. 6 is a perspective view of yet another type of transport system, with loading and unloading ports and a discharge sleeve.

FIG. 6 shows a loading port 60, a discharge port 70, and a discharge sleeve 80. The liner 20 includes a loading port 60 positioned above the straps near the top part of the back panel 25. The loading port 60 receives material that is introduced into the liner 20. In addition, the liner 20 further includes a discharge port 70 positioned below the straps near the bottom part of the back panel 25. The discharge port 70 facilitates the removal of material from inside the liner to another compartment. Finally, a discharge sleeve 80 is attached to the back panel 25 near the discharge port 80. The discharge sleeve 80 helps protect material from contamination as it is being discharged from the liner to another compartment.

What is claimed is:

1. An apparatus for transporting bulk products, comprising:

a. A liner having a bottom panel, two sidewalls, and a back panel;

b. A first strap, wherein the first strap is partially attached to each of the sidewalls and to the back panel so that the first strap has a first pair of diagonal sections, for forming a first diagonal section suspended between the first sidewall and the back panel and a second diagonal section suspended between the second sidewall and the back panel, and wherein at least one overlapping region of the first strap overlaps on said back panel and wherein a second overlapping region of the first strap overlaps on a region of the first sidewall and a third overlapping region of the first strap overlaps on the second sidewall; and c. A second strap, wherein the second strap is partially attached to each of the sidewalls and to the back panel, so that the second strap has a second pair of diagonal sections for forming a third diagonal section suspended between the first sidewall and the back panel and a forth diagonal section suspended between the second side wall and the back panel and wherein a first overlapping region of the second strap overlaps on a region of the first strap on the first side wall and a second overlapping region of the second strap overlaps on a region of the first strap on the second sidewall and a third overlapping region of the second strap overlaps on said first strap overlapped on said back panel.

2. The apparatus of claim 1, wherein the first pair of diagonal sections comprises a plurality of apertures in said first pair of diagonal sections.

3. The apparatus of claim 1, further comprising a third strap that is partially attached to each of the sidewalls and to the back panel.

4. The apparatus of claim 3, wherein the third strap has a third pair of diagonal sections, said third pair of diagonal sections comprising a fifth diagonal section suspended between the first sidewall and the back panel and a sixth diagonal section suspended between the second sidewall and the back panel.

5. An apparatus for transporting bulk products, comprising:

a. A liner for holding bulk products that includes a first sidewall, a second sidewall that is substantially parallel to the first sidewall, and an interconnecting panel disposed between the first and second sidewalls;

b. A first strap that is partially attached to each of the first and second sidewalls and to the interconnecting panel, to provide a first pair of diagonal strap sections, which includes a first diagonal strap section suspended between the first sidewall and the interconnecting panel, and a second diagonal strap section suspended between the second sidewall and the interconnecting panel; and c. A second strap that is partially attached to each of the first and second sidewalls and to the interconnecting panel to provide a second pair of diagonal strap sections, which includes a third diagonal strap section suspended between the first sidewall and the interconnecting panel, and a fourth strap section suspended between the second sidewall and the interconnecting panel, wherein at least a first portion of the first strap overlaps at least a first portion of the second strap to provide a first composite strap structure that includes two overlapping strap portions affixed in planar and parallel relation to one another and wherein a second portion of the first strap overlaps a second portion of the second strap to provide a second composite strap structure that includes two overlapping strap portions and wherein a third portion of the first strap overlaps a third portion of a second strap to provide a third composite strap structure that includes two overlapping strap portions.

6. The apparatus of claim 5, wherein the first composite strap structure is affixed to the first sidewall, the second composite strap structure is affixed to the second sidewall, and a third composite strap structure is affixed to the interconnecting panel.

7. The apparatus of claim 5, wherein the interconnecting panel is a back panel, and the liner additionally comprises a front panel, a top panel, and a bottom panel.

8. An apparatus for use with a container, comprising:

a. A liner having at least two sidewalls and a back panel;

b. A first strap partially attached to each of the sidewalls and the back panel so that the strap has a first pair of diagonal sections, said first pair of diagonal sections comprising a first diagonal section suspended between a first sidewall and the back panel and a second diagonal section suspended between a second sidewall and the back panel, wherein the first pair of diagonal sections comprises a plurality of apertures; and c. a second strap partially attached to each of the sidewalls and the back panel so that the strap has a second pair of diagonal sections, said second pair of diagonal sections comprising a third diagonal section suspended between the first sidewall and the back panel and a fourth diagonal section suspended between the second sidewall and the back panel and wherein the second strap has a center portion that is shorter than a side portion of the strap.

9. The apparatus of claim 8, wherein the first pair of diagonal sections has an edge that descends from the sidewalls to the back panel.

10. The apparatus of claim 8, wherein a center portion of the first strap is shorter than a side portion of the strap.

11. An apparatus for use with a container, comprising:

a. A liner having a bottom panel, two sidewalls, and a back panel; and b. A first strap partially attached to each of the sidewalls and the back panel so that the strap has a first pair of diagonal sections, said first pair of diagonal sections comprising a first diagonal section suspended between a first sidewall and the back panel of a second diagonal section suspended between a second sidewall and the back panel, wherein the back panel is retracted inward from a planar face perpendicular to the first and second sidewalls; and c. a second strap partially attached to each of the sidewalls and the back panel so that the strap has a second pair of diagonal sections, said second pair of diagonal sections comprising a third diagonal section suspended between the first sidewall and the back panel and a fourth diagonal section suspended between the second sidewall and the back panel.

12. The apparatus of claim 11, wherein the first pair of diagonal sections comprises a plurality of apertures in said first pair of diagonal sections.

* * * * *